US005674370A

United States Patent [19]

DuPree

[11] Patent Number: 5,674,370

[45] Date of Patent: Oct. 7, 1997

[54] METHOD OF ELECTROFORMING AN ABRASION SHIELD

[75] Inventor: Donald G. DuPree, Alta Loma, Calif.

[73] Assignee: Optical Radiation Corporation, Azusa, Calif.

[21] Appl. No.: 414,528

[22] Filed: Mar. 31, 1995

[51] Int. Cl.[6] ..... C25D 1/00

[52] U.S. Cl. ..... 205/67; 205/114; 205/118

[58] Field of Search ..... 205/170, 221, 205/118, 120, 122, 67, 70, 73, 128, 114; 264/250, 254, 255, 263

[56] References Cited

U.S. PATENT DOCUMENTS

| | | | |
|---|---|---|---|
| 3,092,558 | 6/1963 | Hughes et al. | 205/67 |
| 3,574,075 | 4/1971 | Eccles | 205/67 |
| 3,649,474 | 3/1972 | Blakeslee et al. | 205/67 |
| 3,892,612 | 7/1975 | Carlson et al. | 156/150 |
| 4,950,375 | 8/1990 | Leger | 204/224 R |
| 5,110,421 | 5/1992 | Gabrielson | 205/221 |
| 5,435,902 | 7/1995 | Andre, Sr. | 205/67 |

*Primary Examiner*—Angela Ortiz
*Attorney, Agent, or Firm*—Christie, Parker & Hale, LLP

[57] ABSTRACT

Electroformed shield having a first part and a second part, the first part having a leg portion and a leading portion and the second part having a leg portion and a leading portion. The leading portions being bonded to form a wedge and a saddle area between the leg portion. The saddle portion accommodating a blade useful in a low-pressure fan for a turbofan jet engine.

8 Claims, 4 Drawing Sheets

METHOD OF ELECTROFORMING AN ABRASION SHIELD

FIELD OF THE INVENTION

This invention relates to protecting the edges of rotor blades and particularly to the protection of the leading edge and possibly the trailing edge of the blades of the low-pressure fan of turbofan jet engines.

BACKGROUND OF THE INVENTION

All propulsion devices that move at high speed through air suffer some amount of erosion. Rain drops, ice and dust particles impinging at high speed will eventually wear out propeller blades, helicopter rotor blades and jet engine fans.

For many years, propellers and helicopter rotor blades have been protected by electroformed nickel abrasion shields. The nickel abrasion shields are more common for blades made of composite materials which consist of high strength fibers, such as Kevlar or graphite embedded in polymerized organic resins. Such composite materials have high strength but low abrasion resistance.

Another form of damage to propellers and fans comes from the striking of objects such as rocks and debris that are thrown up from the runway by the air blast from reverse thrust or by the downwash in the case of helicopters. Another foreign object that has caused damage to propeller blades and blades of jet fans is birds that hit the propeller or fan blade.

Propellers and helicopter rotor blades are relatively massive structures compared to the blades for the fans of jet engines and are therefore relatively immune to damage by foreign objects. As a consequence, only a thin abrasion shield is typically used and an electroformed nickel abrasion shield for this purpose generally extends beyond the front edge of the blade by only 0.020 to 0.050 inches.

Blades of the low-pressure fan of turbofan jet engines are relatively thin compared to the propeller blades and helicopter rotor blades. These blades have been made of metal to better absorb the energy of the foreign objects and to bend and not break into pieces. If they did break into pieces, the pieces could be ingested into the secondary compression stages and combustion chamber of the jet engine with the possibility of causing engine failure.

In recent years, to save weight and improve performance of the blades of jet fans, the blades have been made of titanium or hollow titanium. However, blades of composite material have many advantages over metal blades, including lightness, strength and an unlimited fatigue life. Further, it is believed that fans made up of composite blades cost less to manufacture than the metal blades. However, the present electroformed nickel abrasion shields for propeller blades and helicopter rotor blades are not thick enough or do not extend out from the edge of the blade far enough to provide sufficient strength to protect the composite blade from foreign objects.

The electroforming process is used extensively for the manufacture of erosion protection devices, such as abrasion shields for the leading edge and tip caps of helicopter rotor blades and propeller blades. The processes used are generally nickel processes, either nickel sulfate or nickel sulfamate, with chemical additives to increase hardness and tensile strength. The processes can be varied to produce nickel deposits considered soft at about 250 Diamond Pyramid Hardness (DPH) to very hard approaching 700 DPH.

Likewise, yield strength (0.2% offset) can vary from about 50,000 PSI to over 200,000 PSI. The variations depend on the type and amount of chemical hardener, the electroforming bath parameters and the operating parameters, i.e., current density, temperature, agitation and so forth. Additions of cobalt ions to the solution produces a nickel cobalt alloy. This alloy can produce ultimate tensile strengths approaching 300,000 PSI. As known, practitioners skilled in the electroplating art, can vary the electroforming process to achieve various physical properties in the electrodeposit.

The usual method of forming metal abrasion shields for propeller blades and helicopter rotor blades in its simplest form is to wrap and bond a sheet of uniform thickness metal around the leading edge. A preferred method though is to electroplate a deposit onto the leading edge where the electrodeposit is tapered thick at the leading edge and thinner at the trailing edge of the shield to reduce the overall weight of the shield. When it is not practical to electroplate onto the leading edge, the preferred method is to electroform a metal, usually nickel shield, onto a properly shaped male master tool (mandrel). The electroform is removed from the mandrel as a free-standing electrodeposit which is then bonded to the propeller blade or rotor blade. Again, the electroform is tapered cordwise heavier at the leading edge where the greatest wear or erosion occurs and thinner at the trailing edges to reduce weight. This arrangement (thinner trailing edge) also makes it easier to blend the shield into the air foil shape when attached to a propeller blade or rotor blade.

However, past electroplated or electroformed abrasion shields as noted are usually 0.020 to 0.05 inches in thickness and may reach 0.10 inches thickness at the leading portion and taper to 0.005 inches to 0.012 inches at the trailing edge. It is desirable for blades for fans for turbofan jet engines to have abrasion shields or protectors that are also electroformed. However, the problem is that by using the methods employed for the electroform shields of propeller blades and helicopter rotor blades, it is impossible or impractical to form the desired 0.5 inch length of electroformed metal that becomes the leading edge of the blade. This length for the electroformed shield is at least five times that found in electroformed shields for propeller blades and helicopter rotor blades. The biggest problem in electroforming an abrasion shield for the blade for jet fans is created by the relative thinness of the blade.

On thin cross-sections, as the electrodeposit starts to exceed 0.10 inches in thickness, nodules or dendrites begin to form that prevents further deposition. The edge mushrooms outward which causes a thinning of the electrodeposit behind the mushroom and this further causes runaway treeing and mushrooming to occur. One of the most difficult things to encase in an electrodeposit is a razor blade.

SUMMARY OF THE INVENTION

This invention provides an electroformed shield or protector for the blade that typically has a thickness of about 0.125 inches. The shield extends beyond the edge of the blade by between 0.25 inches and 0.75 inches and preferably at least 0.50 inches.

Composite fan engineers believe that approximately one-half inch of high strength metal is needed on the leading edge of the blade of the fan to adequately protect the blade. This metal must be firmly anchored to the composite fan blade to prevent dislodgement. Also, for proper air flow characteristics, the leading edge should taper smoothly from a sharp or slightly rounded point to the area where it ends and the composite fan blade is exposed.

Composite blades are usually made by a molding process where high strength fibers in a matte or weave are arranged inside a two-piece female mold. The mold is then closed and the monomer is injected and cured. The monomer penetrates the fiber structure and bonds to the saddle area of the abrasion shield. This arrangement also causes the cured composite to fair or mate perfectly with the trailing edges of the abrasion shield. When the mold is opened, an essentially completed air foil structure is the result.

The method of the present invention includes the steps of electroforming a first part having an inner surface facing a first mandrel during the electroforming process; removing the first part from the first mandrel; placing the first part in a holding fixture with the inner surface exposed; placing a second mandrel against the leg portion of the first part in the holding fixture with the leading portion left exposed; electroforming a second part having an inner surface along the leg portion facing the second mandrel and an inner surface along the leading portion bonded to the exposed leading portion of the first part thereby forming a saddle area between the legs and a wedge portion from the bonded leading portions; removing the completed shield from the holding fixture; and removing the second mandrel from the formed saddle portion of the shield.

The method further includes the steps of masking the first mandrel to control the thickness and shape of the electrodeposit on the mandrel and masking the second mandrel and exposed leading potion of the first part to control the thickness and shape of the electrodeposit in forming the second part.

The thickness and shape of the leg portion of the shield is controlled by masking and may either be of uniform thickness throughout the length or may have a selected shape such as a taper from thinner at the remote end to thicker near the wedge or joined leading portions.

An alterative method comprises the steps of electroforming a first part having an outer surface formed against a first mandrel during the electroforming process; placing a second mandrel against the leg portion of the first part; electroforming a second part having a leg portion with the inner surface being formed against the second mandrel and a leading portion with the inner surface being formed against the leading portion of the first part; removing the completed shield from the first mandrel; and removing the second mandrel from the formed saddle portion of the shield.

A blade useful in the low-pressure fan of a turbofan jet engine has an electroformed abrasion shield along at least a portion of the front edge of the blade and a polymerized composite body having high strength fibers physically entrapped in the polymer with the electroformed shield bonded to the composite body during the polymerization of the body.

BRIEF DESCRIPTION OF THE DRAWINGS

The foregoing features of the invention will be better understood upon consideration of the following detailed description of certain preferred embodiments taken in conjunction with the accompanying drawings in which.

DETAILED DESCRIPTION

The preferred method of forming an abrasion shield in accordance with the present invention is illustrated by the cross-sectional views of the apparatus employed during the electroforming process shown in FIGS. 1–4. A mandrel 110 having a surface 111 corresponding to the desired shape of the inner surface of the first part is employed in the electroforming process. The mandrel 110 is preferably made of stainless steel, such as 15-5 PH, which is resistant to the chemicals used in the electroforming process.

Other acceptable metals for the first mandrel 110 are titanium or some other metal that is coated with chromium. The criteria of the mandrel material is that it be conductive to allow current flow and that it have a natural passive surface, such as stainless steel, chromium or titanium, so that the first electroform does not adhere permanently to the first mandrel. Other mandrel materials without naturally occurring passivity may be used, although it would probably be necessary to passivate the surface chemically before use.

Figure 1:
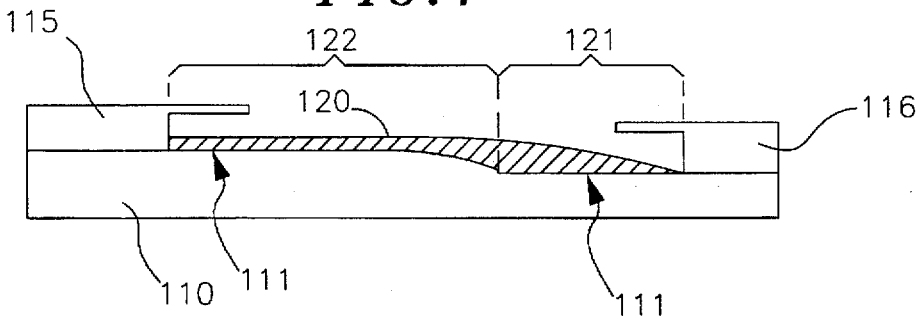
FIGS. 1–4 illustratively show the preferred method of electroforming an abrasion shield in accordance with this invention.
Figure 2:
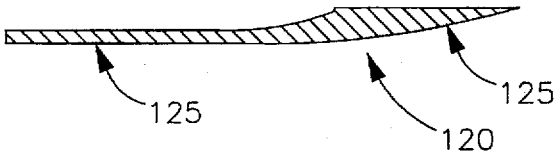

The first mandrel 110 has the cross-section shown in FIG. 1 and a selected length configured to conform to the shape of the fan blade on which the resultant shield is to be employed. The length may be less than or equal to the length of the blade. Typical fan blades are curved and twisted as representatively shown in FIG. 13. Some of the smaller turbofan jet engines have fan blades that are shorter than two feet, while some of the more recent larger turbofan jet engines, for example, jet engines for the Boeing 777, have a length approaching five feet, so that the total diameter of the low-pressure fan is in the order of 120 inches or ten feet. Thus the length of the first mandrel 110 may be as short as less than two feet or longer than four feet, as required by the particular turbofan jet engine.

Generally, the shield has a length equal to the length of the fan blade, but it may be shorter than the total length so that it will only cover a portion of the leading edge of the fan blade.

Masks 115 and 116 are attached to the first mandrel 110 to control the thickness and shape of the electrodeposit on the first mandrel 110. The first mandrel 110 and masks 115 and 116 are placed in a standard electroforming bath with solutions that will provide the desired electroform material. A typical bath of nickel sulfamate and the operating parameters for such a bath are set forth in the pamphlet entitled "Inco Nickel Electroforming" Copyright Inco Limited, 1991, which is incorporated herein by this reference as though set forth in full.

In the electroforming bath, the first part 120 of the electroform shield is formed. The electroformed first part 120 has a leading portion 121 and a leg portion 122.

Figure 3:
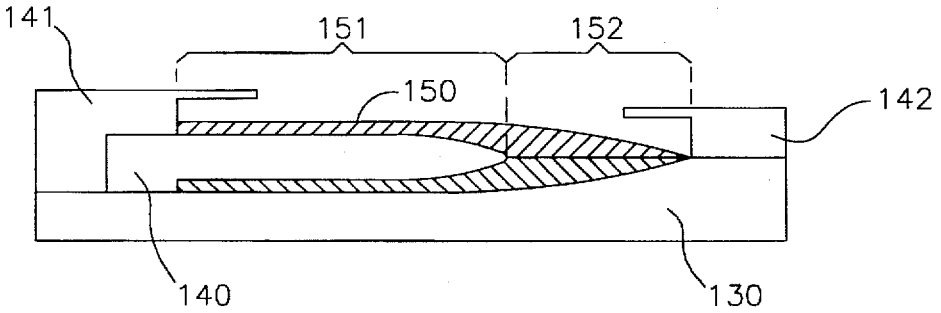

Upon completion of the formation of the first part 120, the first mandrel and masks 115 and 116 with the electroformed part are removed from the bath. The masks 115 and 116 are removed from the first mandrel 110 and then the electroformed first part 120 is separated from the first mandrel 110. This separation may be done by use of a spatula or by a spatula in conjunction with pressurized air from an air nozzle. The first part 120 is then inverted with the inner surface or surface formed against the mandrel 110 facing up to be placed in a holding fixture 130 as shown in FIG. 3. The surface of the holding fixture 130 is formed to conform to the outer surface 125 of the first part 120.

A second mandrel 140, having the shape desired for the saddle area of the electroformed shield, is placed against the inner surface of the leg portion 122 of the first part 120, as shown in FIG. 3. This assembly may be of dry parts. When the second mandrel 140 is installed into the cavity of the electroformed first part, care is taken to effect a tight fit. The tight fit is to minimize the gaps between the mandrel and the electroformed first part.

Masks 141 and 142 are attached to the holding fixture 130 to control the thickness and shape of electrodeposit in forming the second part. Masks 141 and 142 control the current density profile on the second mandrel 140 to produce the desired shape of the electroformed second part 150 shown in FIG. 3.

The assembly is cleaned and activated to remove the natural oxide layer on the exposed surface of the leading portion 121 of the first electroformed part 120. This is to present a fresh chemically active surface for electrochemical bonding by the second electroformed part 150. The activation process strips away a small amount from the surface of the first electroformed part to expose the fresh surface. The amount removed is usually less than 0.0005 inches. The activation or etching is accomplished by reverse DC current in a 20% sulfuric acid solution. Typical cleaning and activation processes are set forth in the book entitled "Metal Finishing Guidebook and Directory 1993" published in January of 1993, Volume 91, No. 1A, by Elsevier, which is incorporated herein by this reference as though set forth in full. The mandrel 140 is preferably titanium and therefore, immune to the activation procedure.

The assembly is then rinsed and placed in a reducing medium and DC current is applied to generate hydrogen gas at the exposed surface of the leading portion of the first part to further reduce any oxides present on the surface. The solution used is a 20% sulfuric acid solution. Further, in the preferred method, this solution is a nickel strike solution composed of nickel ions of low concentration in the compatible sulfuric acid medium. In this strike solution, the direct current reduces the oxides on the leading portion of the first part and deposits highly adherent thin coating of nickel (typically less than 0.001 inches). After activation, the assembly is then immersed in the electroforming bath for the formation of the second part 150.

The leg portion 151 of the second part is formed against the second mandrel 140 and the leading portion 152 is formed against the exposed surface of the leading portion of the first part 120. The electrochemical bonding of the leading portion of the first part and second part forms a wedge that provides an abrasion resistant leading edge for the fan blade. The wedge is tapered smoothly from a slightly rounded point 161 to the beginning of the leg portion to provide the proper air flow characteristic. This shape can be modified as necessary for the particular application of the shield. The area between the leg portion of the first part and the leg portion of the second part is called a saddle and has a configuration of the second mandrel 140. This mandrel is in turn configured to the shape of the part on which the electroformed shield is to be used, e.g., the edge portion to be protected of a fan blade.

When the required thickness of the second part 150 is obtained, the apparatus is removed from the bath and rinsed. Thereafter the masks 141 and 142 are removed and the holding fixture 130 is separated from the completed shield 160.

Figure 4:
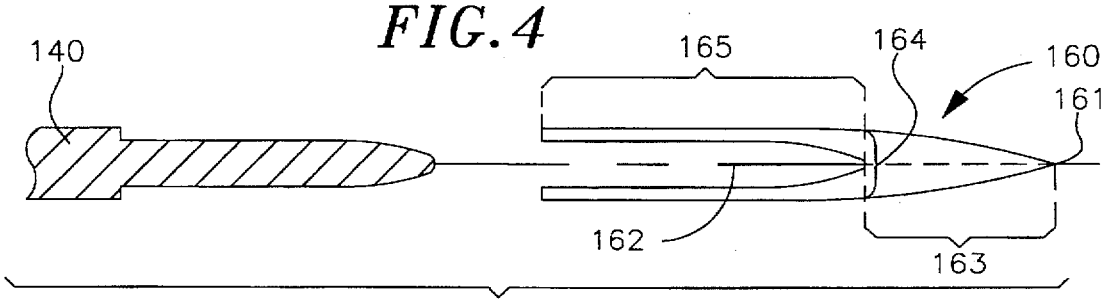

The second mandrel 140 is removed from the completed shield 160 as shown in FIG. 4. Any rough edges on the completed shield 160 are removed by machining the shield. The second mandrel 140 is preferably made of titanium because titanium does not readily activate and the electroform will therefore not adhere to it. During the electroforming process, including the activation portion thereof, the titanium will not be attacked, etched or activated and, consequently, it may be reused many times.

Figure 5:
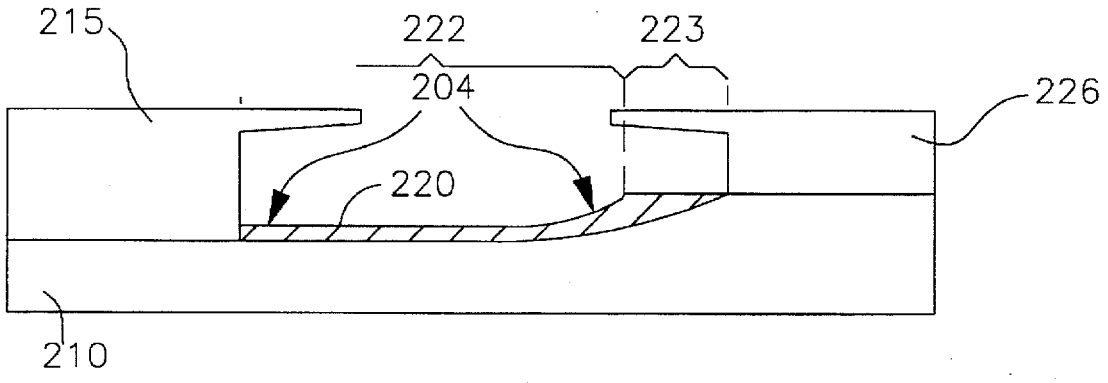
FIGS. 5–7 illustratively show the steps of an alternative method for forming the abrasion shield.
Figure 6:
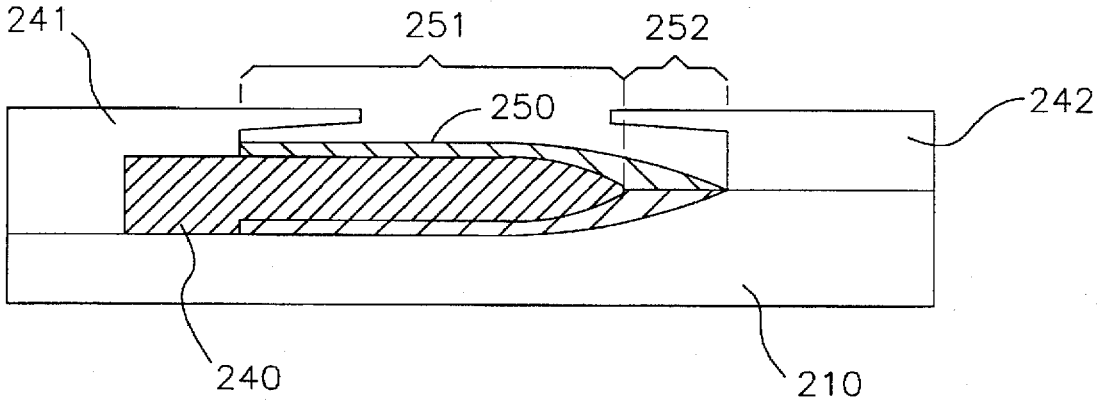
Figure 7:
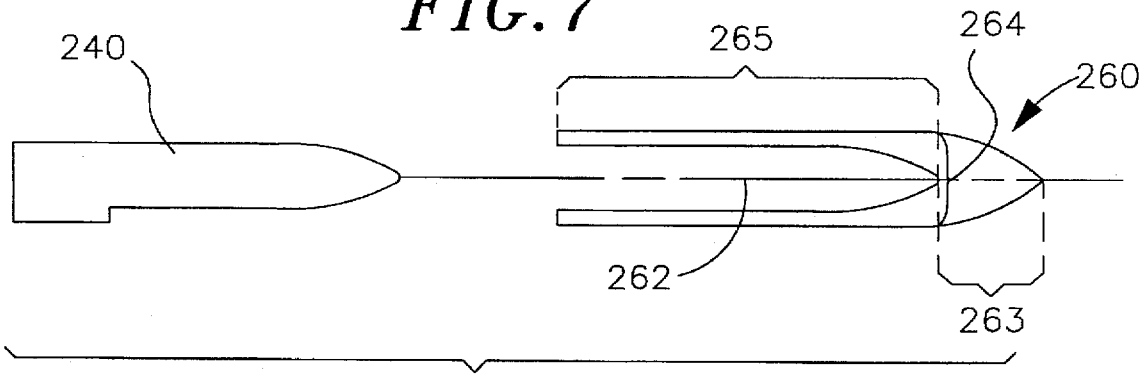
Figure 8:
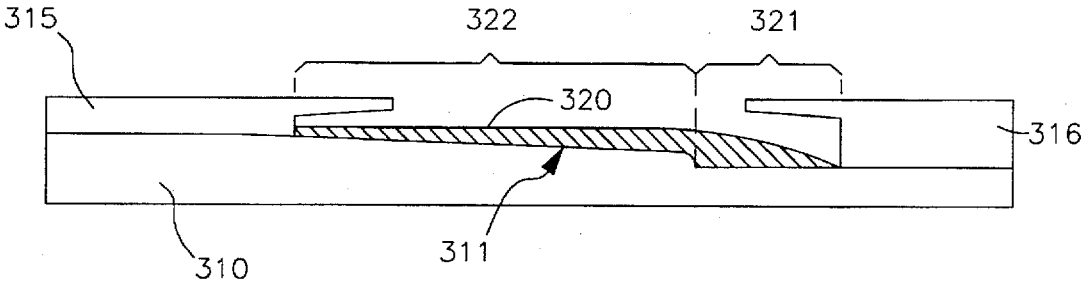
FIGS. 8–11 illustratively show the steps of forming an abrasion shield with tapered legs.
Figure 9:
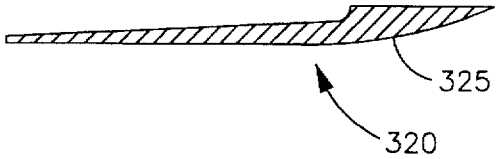
Figure 10:
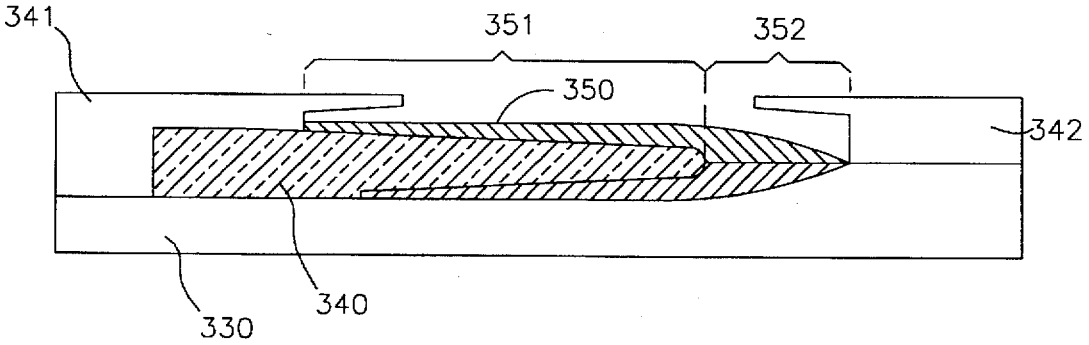

Another method for forming the electroformed shield is generally depicted in FIGS. 5–7. In the method depicted in FIGS. 5–7, there are fewer steps than in the method of FIGS. 1–4. Although acceptable shields may be produced by this method, they may not be as good as those produced by the methods of FIGS. 1–4. In the method of FIGS. 5–6, the as-deposited surface 204 in the leg portion mates with a titanium mandrel 240 to form the saddle of the shield. Because of the mandrel being against an as deposited surface, the fit between the mandrel and the first electroform is not as good as found in the method of FIGS. 1–4 because the as-deposited surface is never as precise a contour as the mandrel side of an electroform as is done in FIGS. 1–4.

In this alternate method, as shown in FIG. 5, the first part 220 is formed against a mandrel 210. The outside surface of the first part 220 is formed against the mandrel 210 and has the smooth contour of the mandrel.

The initial steps of attaching masks 215 and 216 to the mandrel 210 are completed and the mandrel is cleansed with detergent water and a brush and then rinsed before being inserted into the electroforming bath.

The first part 220 of the shield is electrodeposited on the mandrel 210 in the bath and when the desired thickness and shape is attained, the assembly is removed from the bath. The masks 215 and 216 are then removed, and a mandrel 240 having the shape of the desired saddle is put in place against the leg portion of the first part 220 as shown in FIG. 6. Masks 241 and 242 are then attached to the mandrel 210 to provide the desired thickness and shape of the electroformed second part. The masks are configured to control the electrodeposition on the mandrel and exposed leading portion of the first part 220. By adjusting the configuration of the masks 241 and 242, the depth and contour of the electrodeposit forming the second part are controlled to give the desired shape and thickness to the second part.

In both methods illustrated in the drawings (FIGS. 1–4 and FIGS. 5–7) the electroformed shield may be symmetrical with respect to a plane 162 and 262, respectively, through the electrochemically bonded surfaces of the first and second part. Alternatively, the parts may be quite different. Further, the leading portion of each of the parts may be contoured to provide a very sharp point and a long thin nose compared to the rather blunt point and tapered nose shown in the drawings of FIGS. 4 and 7.

Figure 11:
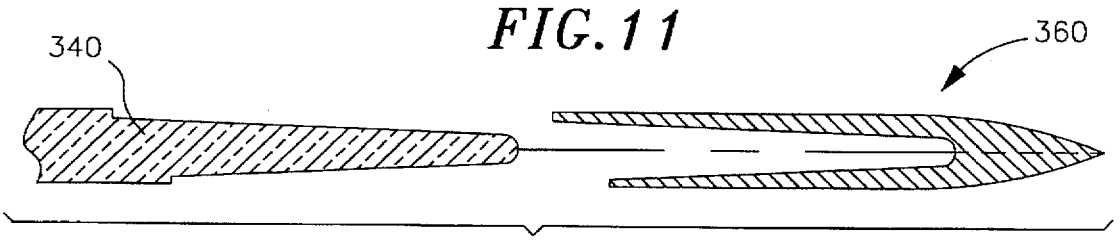

The length of each leg portion and each leading portion of the two parts of the shield are determined by the shape of the mandrels and the positioning and shape of the masks during the electroforming process. These lengths can be adjusted to be the length required for the particular application and may be shorter or longer than two inches. An electroformed shield for the blades of a low-pressure fan of a turbofan jet engine will typically have a wedge formed by the leading portions of the electrochemically bonded leading portions of the first and second parts. Preferably this wedge has a length 163 and 263, respectively, of approximately 0.50 inches. This is about ten times the length or thickness of shields used on propeller blades and helicopter rotor blades. The wedge has a thickness 164 and 264, respectively, near the end of the saddle of approximately 0.125 inches, which is the same dimension as the thickness of the blade beyond the shield. Each leg of the shield 165 and 265, respectively, is about two inches long. As noted above and as shown in FIGS. 11 and 14, one leg may be longer than the other. Additionally, the part of the shield that is on the wind side of the blade may have more nickel in the electrodeposit to provide greater abrasion resistance.

Further, where the shield is to be used on a fan blade the masks may be adjusted to produce a leading edge, 163 or 263, that varies over the length of the shield. (See FIG. 13). The end 301 near the hub, called the root end, may be 0.25", with an increase in thickness to 0.5" or more at the blade top where the greatest wear occurs.

When the desired thickness and contour of the second part is completed, the assembly is removed from the electroplating bath. The mask 241 and 242 are removed from the mandrel 210 and the shield 260 is also removed from the mandrel 210. Thereafter, as shown in FIG. 7, the titanium mandrel 240 is removed from the finished electroformed shield 260.

Method 3, which is a variation of the first method depicted in FIGS. 1–4, is shown in FIGS. 8–11. The difference being the tooling used in method 3 is such that the legs of each part 320 and 350 of the shield are tapered from the wedge end to the end remote from the wedge end, being thinner at the remote end. Additionally, the tooling is such that one leg 351 is longer than the other 322.

For a jet fan blade, the wedge has a length of approximately 0.5 inches and one leg is approximately 2 inches in length while the other leg is approximately 1½ inches in length. The legs taper to approximately 0.005 inches at the remote ends, which provides a larger opening for the saddle and also a lighter weight shield. Each leg has a thickness of approximately 0.03 inches at the end near the wedge.

Figure 12:
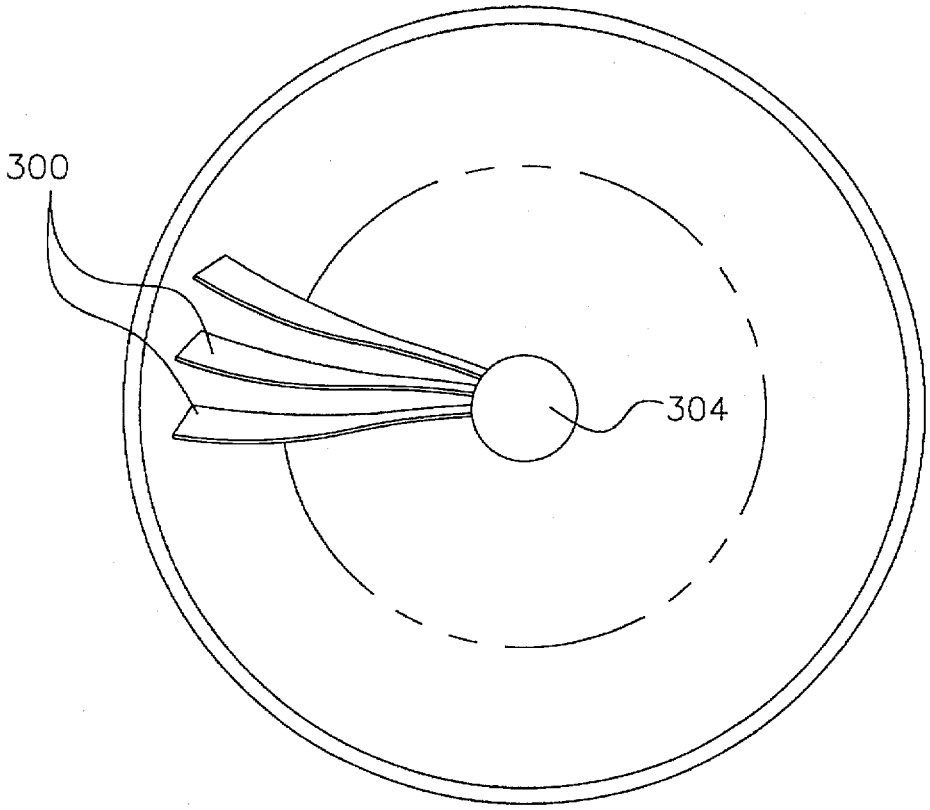
FIG. 12 is a schematic representation of the low-pressure fan of a turbofan jet engine with a few blades in place.
Figure 13:
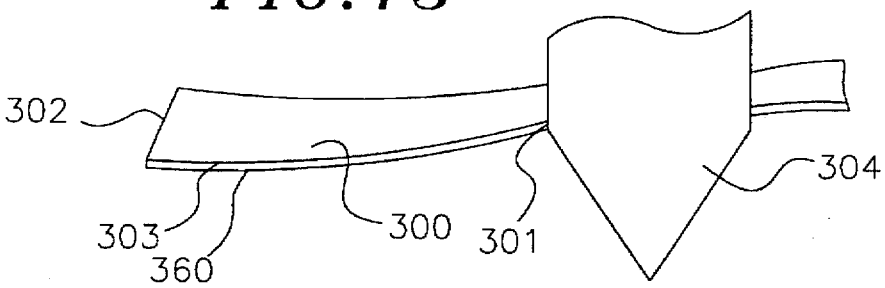
FIG. 13 is a top plan view of one blade connected to the inlet cone of the low-pressure fan.

A front end of a turbofan jet engine is illustratively depicted in FIG. 12 with a few of the blades of the low-pressure fan being depicted attached to an inlet cone 304 of the engine. As noted, the diameter of the low-pressure fan varies depending upon the particular turbofan jet engine in which the fan is being employed. The top plan view of the blade 300 is shown in FIG. 13. It is noted that the front or leading edge of the blade 300 is curved and also that the blade has a twist from one end to the other. The hub end 301 of the blade is attached to the inlet cone 304 and the blade has an end 302 remote from the hub end. As shown in FIG. 13, the blade has an electroformed shield that extends from the remote end 302 to the hub end 301 along the leading edge or front of the blade. An electroformed shield may also be attached to the trailing edge of the blade, if desired.

Figure 14:
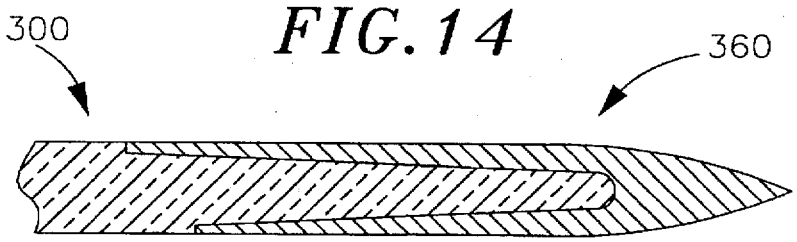
FIG. 14 is a cross-sectional view of a portion of a completed composite blade for a jet fan having an abrasion shield in accordance with the present invention.

A composite blade with an electroformed shield is depicted in FIG. 14. The composite blade 300 for the low-pressure fan of the turbofan jet engine typically has a height or thickness of 0.125 inches that tapers down to the point at the leading edge provided by the electroformed shield 360. In forming the blade 300, a mold having the desired dimensions and configuration is used. The electroformed shield 360 is placed in the mold where the leading edge of the composite blade is to be formed. A similar electroformed shield may be placed at the location of the trailing edge of the blade. Each shield may have a length equal to the length of the blade to be formed or may have some lesser length and be positioned anywhere along the length of the blade. Once the shield or shields are in position in the mold, high strength fibers used in the composite blade are placed in the mold and into the saddle[s] along the entire length of the shield. Thereafter, the mold is closed and the monomer for the composite blade is injected into the mold and cured.

Preferred methods of forming and the resultant electroformed shield are described as well as a composite blade with the shield molded in place. Various changes may be made in the method, apparatus and end product, without departing from the spirit and scope of the invention.

What is claimed is:

1. A method of forming a saddle-shaped abrasion shield having a top leg portion and a bottom leg portion and a bonded leading portion suitable for a blade of a low-pressure fan of a turbofan jet engine, said method comprising the sets of:

electroforming against a first mandrel a first part comprising a leg portion and a leading portion, said leading portion having an inner surface facing the first mandrel during the electroforming process;

removing the first part from the first mandrel;

placing the first part in a holding fixture with the inner surface of the leading portion exposed;

placing a second mandrel against the leg portion of the first part in the holding fixture with the inner surface of the leading portion left exposed;

electroforming a second part comprising a leg portion and a leading portion, whereby said leading portion bonds to the exposed inner surface of the leading portion of the first part thereby forming a saddle-shaped abrasion shield having a pair of spaced apart legs connected by a bonded leading portion;

removing the shield from the holding fixture; and removing the second mandrel from the space between the legs of the shield.

2. The method in accordance with claim 1 further comprising the steps of masking the first mandrel to control the thickness and shape of the first part and masking the second mandrel and exposed inner surface of the leading portion of the first part to control the thickness and shape of the second part.

3. The method in accordance with claim 1 further comprising:

providing at least one first mask near the first mandrel during electroforming of the first part, said at least one first mask having a shape and location relative to the first mandrel selected to cause the leg portion of the first part to have uniform thickness over the length of the leg portion and to cause the leading portion of the first part to have a selected thickness and shape; and providing at least one second mask near the second mandrel and exposed inner surface of the leading portion of the first part during electroforming of the second part, said at least one second mask having a shape and location relative to the second mandrel and exposed inner surface of the leading portion of the first part to cause the leg portion of the second part to have uniform thickness over the length of the leg portion and to cause the leading portion of the second part to have a selected thickness and shape.

4. The method in accordance with claim 1 further comprising:

providing at least one first mask near the first mandrel during electroforming of the first part, said at least one first mask having a shape and location relative to the first mandrel selected to cause the leg portion of the first part to end near the leading portion of the first part then at its end remote from the leading portion and to cause the leading portion of the first part to have a selected thickness and shape; and providing at least one second mask near the second mandrel and exposed inner surface of the leading portion of the second part during electroforming of the second part, said at least one second mask having a shape and location relative to the second mandrel and inner surface of the leading portion of the second part selected to cause the leg portion of the second part to have greater thickness at its end near the leading portion of the second part than at its end remote from the leading portion and to cause the leading portion of the second part to have a selected thickness and shape.

5. A method of forming a saddle-shaped abrasion shield having a top leg portion and a bottom leg portion and a bonded leading portion for a blade of a low-pressure fan of a turbofan jet engine, said method comprising the steps of:

electroforming against a first mandrel a first part comprising a leg portion and a leading portion, said leading portion having an outer surface;

placing a second mandrel against the leg portion of the first part;

electroforming against the second mandrel a second part comprising a leg portion and a leading portion, whereby said leading portion of the second part bonds to the outer surface of the leading portion of the first part thereby forming a saddle-shaped abrasion shield having pair of spaced apart legs connected by a bonded leading portion;

removing the shield from the first mandrel; and removing the second mandrel from the space between the legs of the shield.

6. A method in accordance with claim 5 further comprising the steps of making the first mandrel to control the thickness and shape of the first part and masking the second mandrel and exposed outer surface of the leading portion of the first part to control the thickness and shape of the second part.

7. The method in accordance with claim 5 further comprising:

providing at least one first mask near the first mandrel during electroforming of the first part, said at least one first mask having a shape and location relative to the first mandrel selected to cause the leg portion of the first part to have uniform thickness over the length of the leg portion and to cause the leading portion of the first part to have a selected thickness and shape; and providing at least one second mask near the second mandrel and exposed outer surface of the leading portion of the first part during electroforming of the second part, said at least one second mask having a shape and location relative to the second mandrel and exposed outer surface of the leading portion of the first part to cause the leg portion of the second part to have uniform thickness over the length of the leg portion and to cause the leading portion of the second part to have a selected thickness and shape.

8. The method in accordance with claim 5 further comprising:

providing at least one first mask near the first mandrel during electroforming of the first part, said at least one first mark having a shape and location relative to the first mandrel selected is masked the leg portion of the first part to end near the leading portion of the first part then at its end remote from the leading portion and to cause the leading portion of the first part to have a selected thickness and shape; and providing at least one second mask near the second mandrel and exposed outer surface of the leading portion of the second part during electroforming of the second part, said at least one second mask having a shape and location relative to the second mandrel and outer surface of the leading portion of the second part selected to cause the leg portion of the second part to have greater thickness at its end near the leading portion of the second part than at its end remote from the leading portion and to cause the leading portion of the second part to have a selected thickness and shape.

* * * * *